US007497785B2

(12) United States Patent
Koncelik, Jr.

(10) Patent No.: US 7,497,785 B2
(45) Date of Patent: Mar. 3, 2009

(54) GOLF CLUB SWING IMPROVEMENT DEVICE

(76) Inventor: Lawrence J. Koncelik, Jr., 10 Gingerbread La., East Hampton, NY (US) 11937

( * ) Notice: Subject to any disclaimer, the term of this patent is extended or adjusted under 35 U.S.C. 154(b) by 333 days.

(21) Appl. No.: 11/294,728

(22) Filed: Dec. 6, 2005

(65) Prior Publication Data

US 2007/0129159 A1 Jun. 7, 2007

(51) Int. Cl.
*A63B 69/36* (2006.01)

(52) U.S. Cl. ..... 473/228; 473/226

(58) Field of Classification Search ..... 473/226–228; 5/417, 496; 2/67, 69; 297/228.11; 116/173; 281/29, 32, 35
See application file for complete search history.

(56) References Cited

U.S. PATENT DOCUMENTS

| | | | | |
|---|---|---|---|---|
| 1,069,776 | A | 8/1913 | Foulis | 116/174 |
| 1,171,699 | A | 2/1916 | Brown | |
| 1,519,052 | A | 12/1924 | Reach | |
| 2,688,303 | A | 9/1954 | Leander | 116/173 |
| 2,771,678 | A | 11/1956 | Hansen, Sr. | |
| 2,898,109 | A | 8/1959 | Williams | |
| 3,262,705 | A | 7/1966 | Nuziato | |
| 3,565,444 | A | 2/1971 | Larocca | |
| 3,715,821 | A | 2/1973 | Hawes | 40/591 |
| 3,776,556 | A | 12/1973 | McLaughlin | |
| 4,204,332 | A | 5/1980 | Gray | |
| 4,227,406 | A | 10/1980 | Coffey | |
| 4,236,271 | A | 12/1980 | Martino | |
| 4,257,607 | A | 3/1981 | Nedwick | |
| 4,576,378 | A | 3/1986 | Backus | |
| 4,601,255 | A | 7/1986 | Marcotti | 116/173 |
| 4,603,652 | A | 8/1986 | Thibault et al. | 116/174 |
| 4,656,670 | A * | 4/1987 | Schluter | 2/29 |
| 4,813,369 | A | 3/1989 | Moreland | |
| 4,844,540 | A * | 7/1989 | Pegram | 297/229 |
| 4,875,431 | A | 10/1989 | Dobosz | |
| 4,901,662 | A | 2/1990 | Sandeen et al. | |
| 4,984,379 | A | 1/1991 | Lee | 40/334 |
| 5,029,854 | A | 7/1991 | Laskowitz et al. | |
| 5,174,577 | A | 12/1992 | Warde et al. | |
| 5,184,825 | A | 2/1993 | Ruth | |
| 5,207,174 | A | 5/1993 | Fabbrini | |
| 5,228,695 | A | 7/1993 | Meyer | |
| 5,273,278 | A | 12/1993 | Beeker | |
| 5,310,188 | A | 5/1994 | Hernberg | |
| 5,335,918 | A | 8/1994 | Rupnik et al. | |
| 5,398,928 | A | 3/1995 | Rudell et al. | |
| 5,400,437 | A | 3/1995 | Koutras | |

(Continued)

*Primary Examiner*—Raleigh W. Chiu
(74) *Attorney, Agent, or Firm*—Walter J. Tencza, Jr.

(57) ABSTRACT

An apparatus is provided comprising a flexible body portion and a first ring attached to the flexible body portion. The first ring typically surrounds a first opening in the flexible body portion. The first opening may typically be about equal to or larger than the diameter of an end of a typical golf club handle. The apparatus may include a rigid member attached to the flexible body portion substantially along the entire length of the flexible body portion. A flexible body portion and a band are also provided. The flexible body portion typically can be folded over itself and a first portion of the flexible body portion can be inserted between the band and a second portion of the flexible body portion to attach the flexible body portion to a shaft of a golf club.

1 Claim, 7 Drawing Sheets

U.S. PATENT DOCUMENTS

| | | | | |
|---|---|---|---|---|
| 5,423,281 | A | 6/1995 | Crookham | |
| 5,517,941 | A | 5/1996 | Fisher | |
| 5,527,039 | A | 6/1996 | Levesque | |
| 5,571,048 | A | 11/1996 | Kenney | |
| 5,658,205 | A | 8/1997 | Bartscherer | |
| 5,984,799 | A | 11/1999 | Romano | |
| 6,045,364 | A | 4/2000 | Dugan et al. | |
| 6,238,299 | B1 | 5/2001 | Barnette | |
| 6,381,812 | B1 * | 5/2002 | Crider et al. | 24/306 |
| 6,519,793 | B2 * | 2/2003 | Le Gette et al. | 5/417 |
| 6,648,410 | B2 * | 11/2003 | Sparks | 297/228.12 |
| 6,692,370 | B2 | 2/2004 | Koncelik, Jr. | 473/234 |
| 6,733,399 | B2 | 5/2004 | Koncelik, Jr. | 473/219 |

* cited by examiner

GOLF CLUB SWING IMPROVEMENT DEVICE

FIELD OF THE INVENTION

This invention relates to devices for improving an individual's golf game.

BACKGROUND OF THE INVENTION

Various devices are known in the art for improving an individual's golf game.

SUMMARY OF THE INVENTION

One embodiment of the present invention provides an apparatus comprising a flexible body portion and a first ring attached to the flexible body portion. The first ring typically surrounds a first opening in the flexible body portion. The first opening may typically be about equal to or larger than the diameter of an end of a typical golf club handle. For example the first opening may be approximately one inch to one and three quarters inches. The apparatus may be further comprised of a second ring attached to the flexible body portion. The second ring typically surrounds a second opening in the flexible body portion. The second opening may be about equal to or greater than the diameter of an end of a typical golf club handle. The second opening may be approximately one inch to one and three quarters of an inch.

The flexible body portion may have a first edge and a second edge, which is opposite the first edge. The first ring may be fixed nearer the first edge than the second edge of the body portion. The second ring may be fixed nearer the second edge than the first edge of the body portion.

The apparatus may further include a golf club comprised of a shaft having first and second ends. The first end of the shaft may be attached to a club head and the second end of the shaft may be attached to the typical golf club handle. An end of the typical golf club handle may be inserted through the first opening so that the body portion is attached to the golf club through the first ring. The body portion is typically able to rotate around the shaft of the golf club.

The apparatus may include a rigid or semi rigid member attached to the flexible body portion substantially along the entire length of the flexible body portion and an attachment device for attaching the flexible body portion and the rigid member to a golf club shaft.

In one embodiment of the present invention, an apparatus is provided including a flexible body portion and a band. The band may have first and second ends attached to first and second opposing edges, respectively, of the flexibly body portion. The flexible body portion typically can be folded over itself and a first portion of the flexible body portion can be inserted between the band and a second portion of the flexible body portion to attach the flexible body portion to a shaft of a golf club.

In one embodiment of the present invention a method is provided comprising attaching a first ring and/or second ring to a golf club shaft, wherein the first ring and/or second rings are attached to a flexible body portion.

DETAILED DESCRIPTION OF THE DRAWINGS

Figure 1:
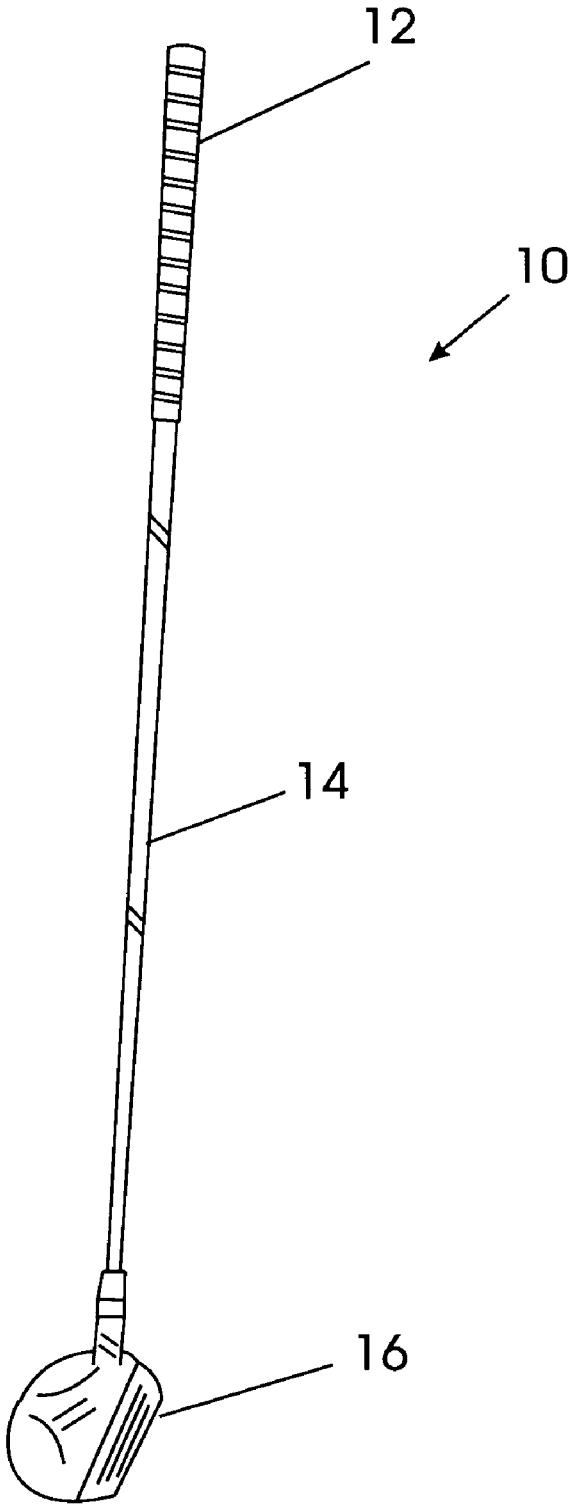
Fig. 1 ( Prior Art)
FIG. 1 shows a perspective view of a prior art golf club.

FIG. 1 shows a perspective view of a prior art golf club 10. The golf club 10 includes a handle, a shaft, and a club head 16.

Figure 2:
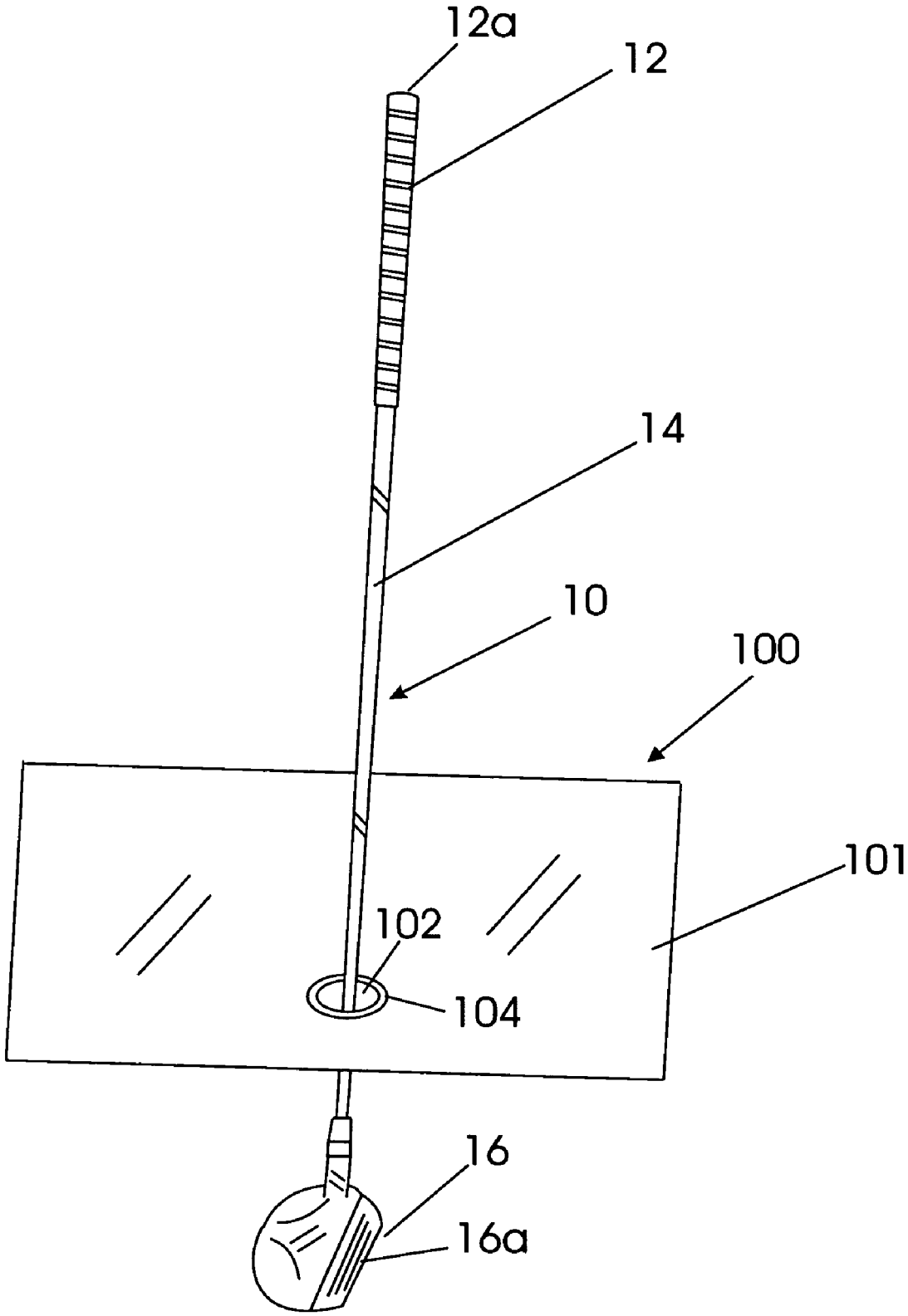
FIG. 2 shows a perspective view of a towel having a ring surrounding an opening, wherein the towel is shown placed on the golf club of FIG. 1.

FIG. 2 shows a perspective view of a towel, cloth or other material 100 having a ring 104 surrounding an opening 102, wherein the towel 100 is shown placed on the golf club 10 of FIG. 1. The towel 100 has a body portion 101, which is typically flexible and may be made of cotton. The ring 104 is typically rigid and may be made of nylon or cotton. The opening 102 may be circular. An end 12*a* of the handle 12 can be inserted through the opening 102 and the towel 100 can be slid into the position shown in FIG. 2 or closer to the club head 16. The towel 100 includes a body portion 101, which may be made of cotton. When the golf club 10 is gripped by the handle 12 and the golf club 10 is swung in a normal manner to hit a golf ball with face 16*a* of club head 16, the towel 100 will rotate. The towel 100 remains on the shaft 14 while the towel 100 rotates on the shaft 14.

Figure 3:
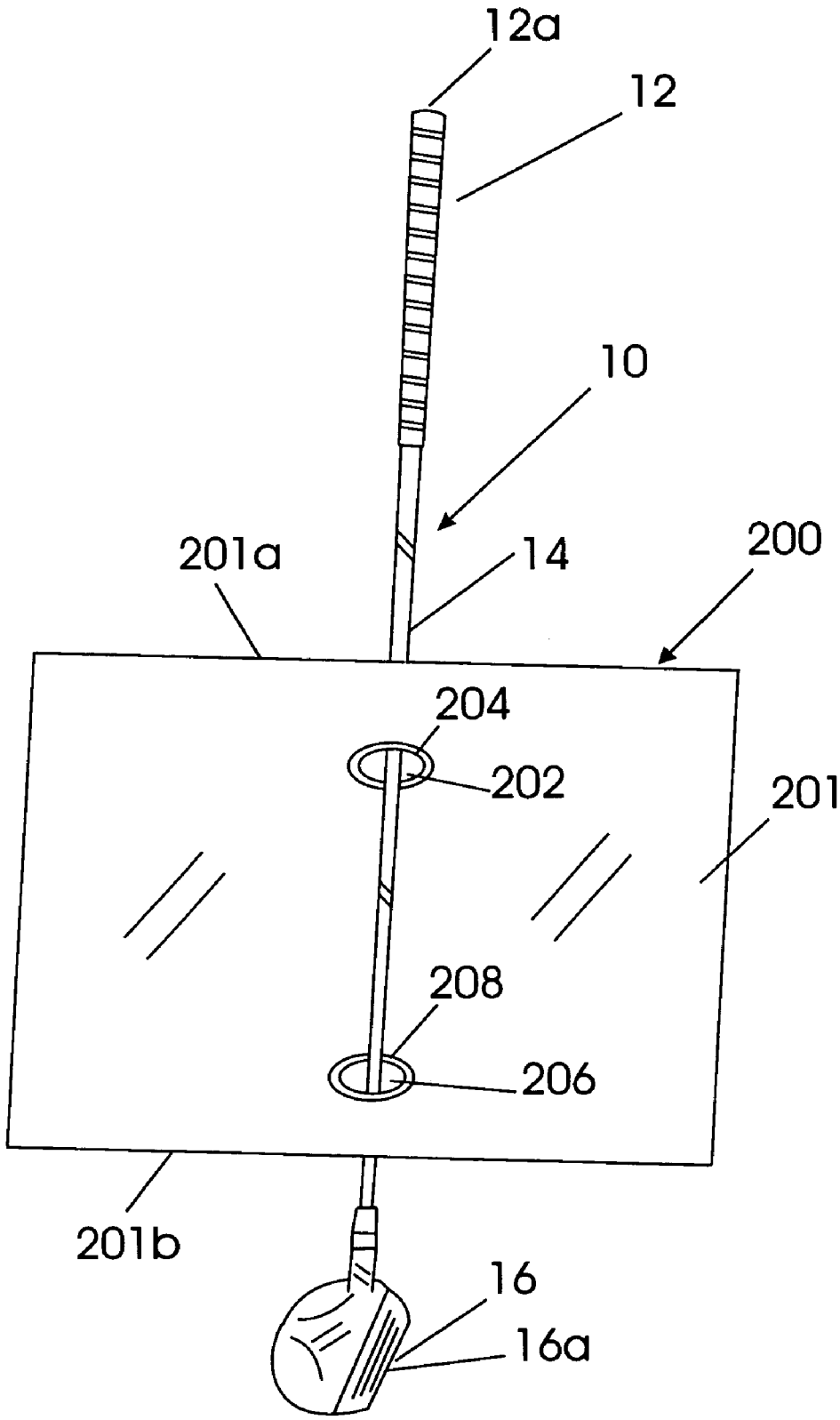
FIG. 3 shows a perspective view of a towel having two rings surrounding two openings, wherein the towel is shown placed on the golf club of FIG. 1.

FIG. 3 shows a perspective view of a towel 200 having a ring 204 and a ring 208 surrounding openings 202 and 206, respectively. The towel 200 is shown placed on the golf club 10. The towel 200 includes a body portion 201 which may be made of the same material as the body portion 101 of towel 100. The rings 204 and 208 may be similar to the ring 104. The ring 204 may be placed nearer to an edge 201*a* of the body portion 201 than to an edge 201*b*. The ring 208 may be placed nearer to the edge 201*b* of the body portion 201 than to the edge 201*a*. The openings 202 and 206 may be circular. The end 12*a* of the handle 12 of golf club 10 can be inserted through the openings 202 and 206 and the towel 200 can be slid into the position shown in FIG. 3 or closer to the club head 16. When the golf club 10 is gripped by the handle 12 and the golf club 10 is swung in a normal manner to hit a golf ball with face 16*a* of club head 16, the towel 200 will rotate. The towel 200 remains on the shaft 14 while the towel 200 rotates on the shaft 14.

Figure 4:
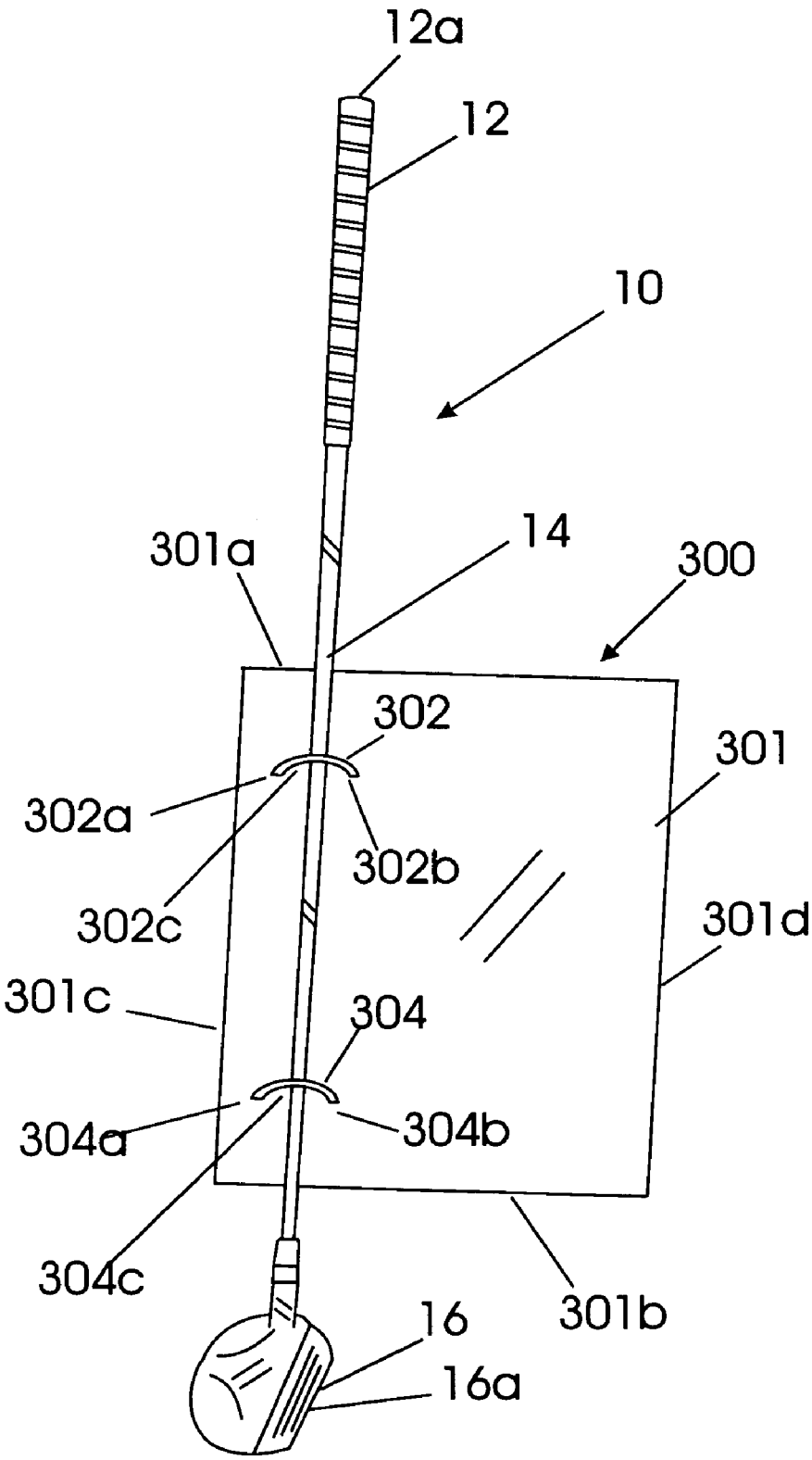
FIG. 4 shows a perspective view of a towel having two attachment devices or loops, wherein the towel is shown placed on the golf club of FIG. 1.

FIG. 4 shows a perspective view of a towel 300 having two attachment devices or loops 302 and 304, wherein the towel 300 is shown placed on the shaft 14 of the golf club 10 of FIG. 1. The attachment device 302 may have ends 302*a* and 302*b*, which are attached to a body portion 301. There may be a space or slot 302*c* between the attachment device 302 and the body portion 301 for inserting the end 12*a* of the handle 12 of the golf club 10 to attach the towel 300 to the golf club 10. The attachment device 304 may have ends 304*a* and 304*b*, which are attached to a body portion 301. There may be a space or slot 304*c* between the attachment device 304 and the body portion 301 for inserting the end 12*a* of the handle 12 of the golf club 10 to attach the towel 300 to the golf club 10.

The towel 300 includes a body portion 301 which may be made of the same material as the body portions 101 or 201 of towels 100 or 200, respectively. The attachment device 302 may be placed nearer to an edge 301*a* of the body portion 301 than to an edge 301*b*. The attachment device 304 may be fixed or attached nearer to the edge 301*b* of the body portion 301 than to the edge 301*a*. The attachment devices 302 and 304 may be fixed or attached nearer to an edge 301*c* of the body portion 301 than to an edge 301*d*.

For the embodiment of FIG. 4, when the golf club 10 is gripped by the handle 12 and the golf club 10 is swung in a normal manner to hit a golf ball with face 16*a* of club head 16, the towel 300 will rotate. The towel 300 remains on the shaft 14 while the towel 300 rotates on the shaft 14.

Figure 5:
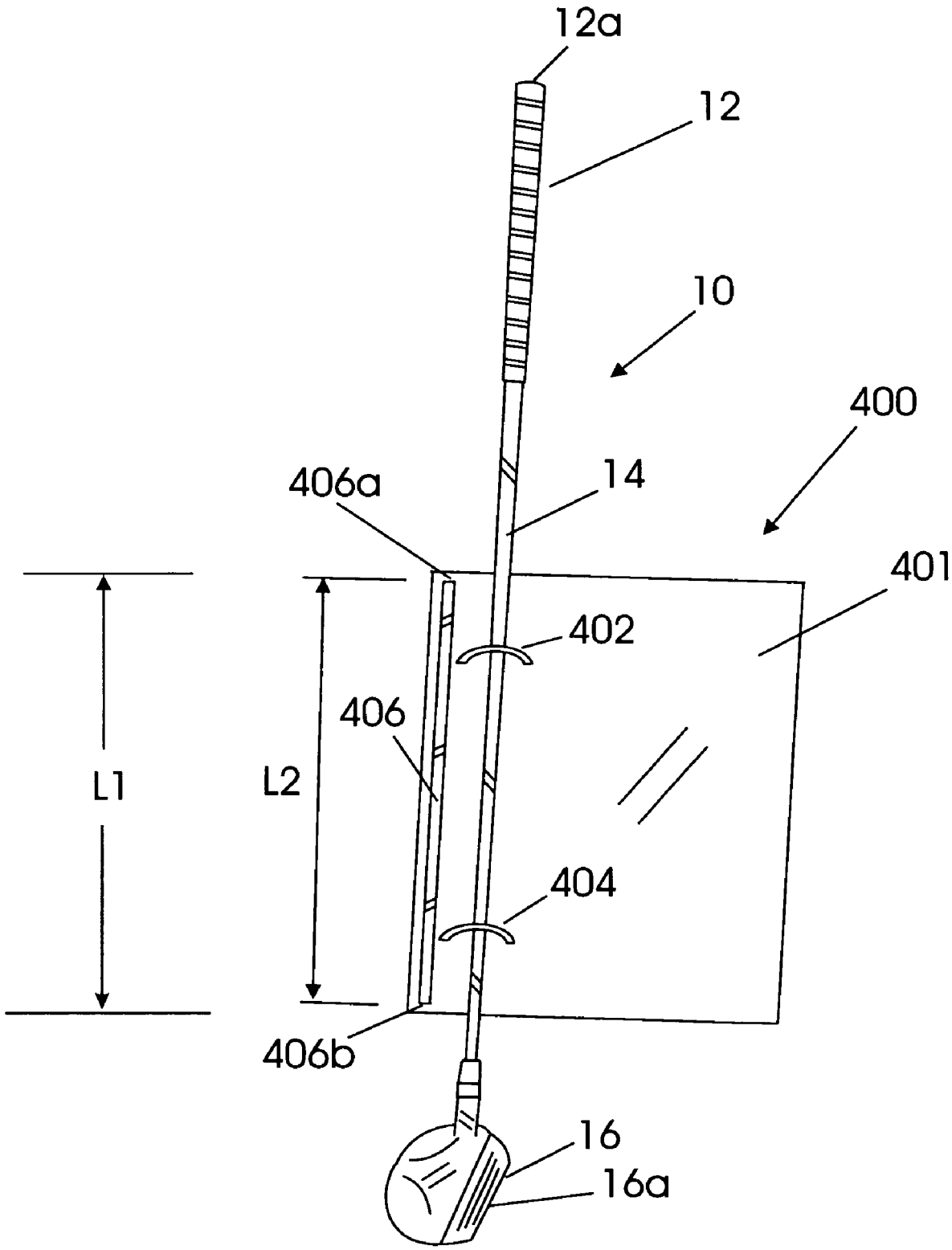
FIG. 5 shows a perspective view of a towel having two attachment devices or loops and a rigid member, wherein the towel is shown placed on the golf club of FIG. 1.

FIG. 5 shows a perspective view of a towel 400 having two attachment devices 402 and 404 or loops which are similar to attachment devices 302 and 304 of FIG. 4. The towel 400 also includes a rigid member 406 having ends 406*a* and 406*b*. The rigid member 406 is fixed to the body portion 401 of the towel 400. The rigid member 406 is typically fixed substantially along the entire length of the rigid member 406 to the body portion 401. For example, the rigid member 406 may be glued or otherwise adhered to the body portion 401 substantially along the entire length of the rigid member 406. The rigid member 406 prevents the towel 401 from collapsing along the length, L1, of the towel 400 underneath the rigid member 406. The rigid member 406 may have a length L2 that is substantially the same as the length L1 of the body portion 401 of the towel 400. The body portion 401 may be similar to the body portion 301 of FIG. 4.

For the embodiment of FIG. 5, when the golf club 10 is gripped by the handle 12 and the golf club 10 is swung in a normal manner to hit a golf ball with face 16*a* of club head 16, the towel 400 will rotate. The towel 400 remains on the shaft 14 while the towel 400 rotates on the shaft 14.

Figure 6A:
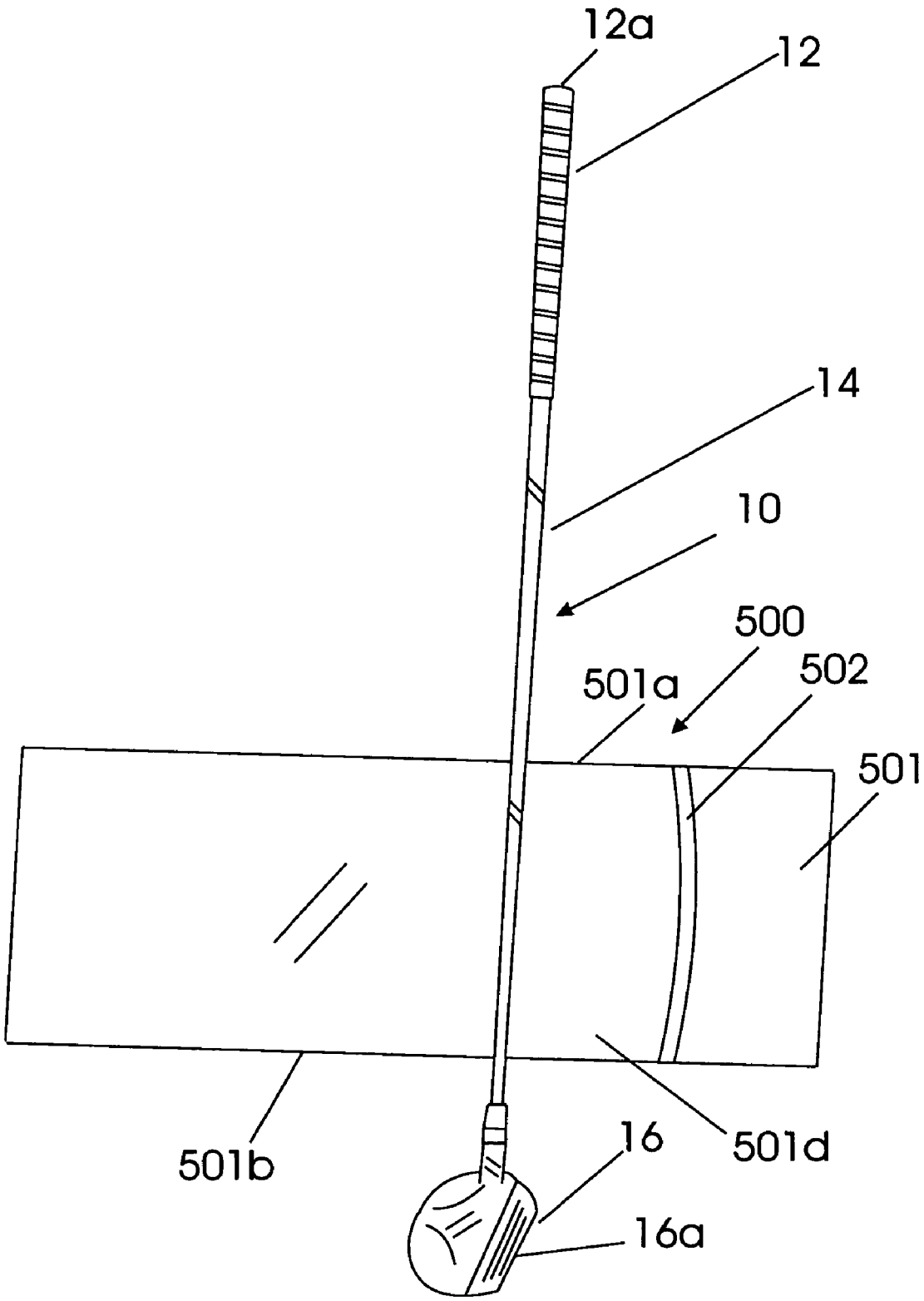
FIG. 6A shows a perspective view of a towel having a band for attaching the towel to a golf club, wherein the towel is shown next, but not attached to the golf club of FIG. 1.
Figure 6B:
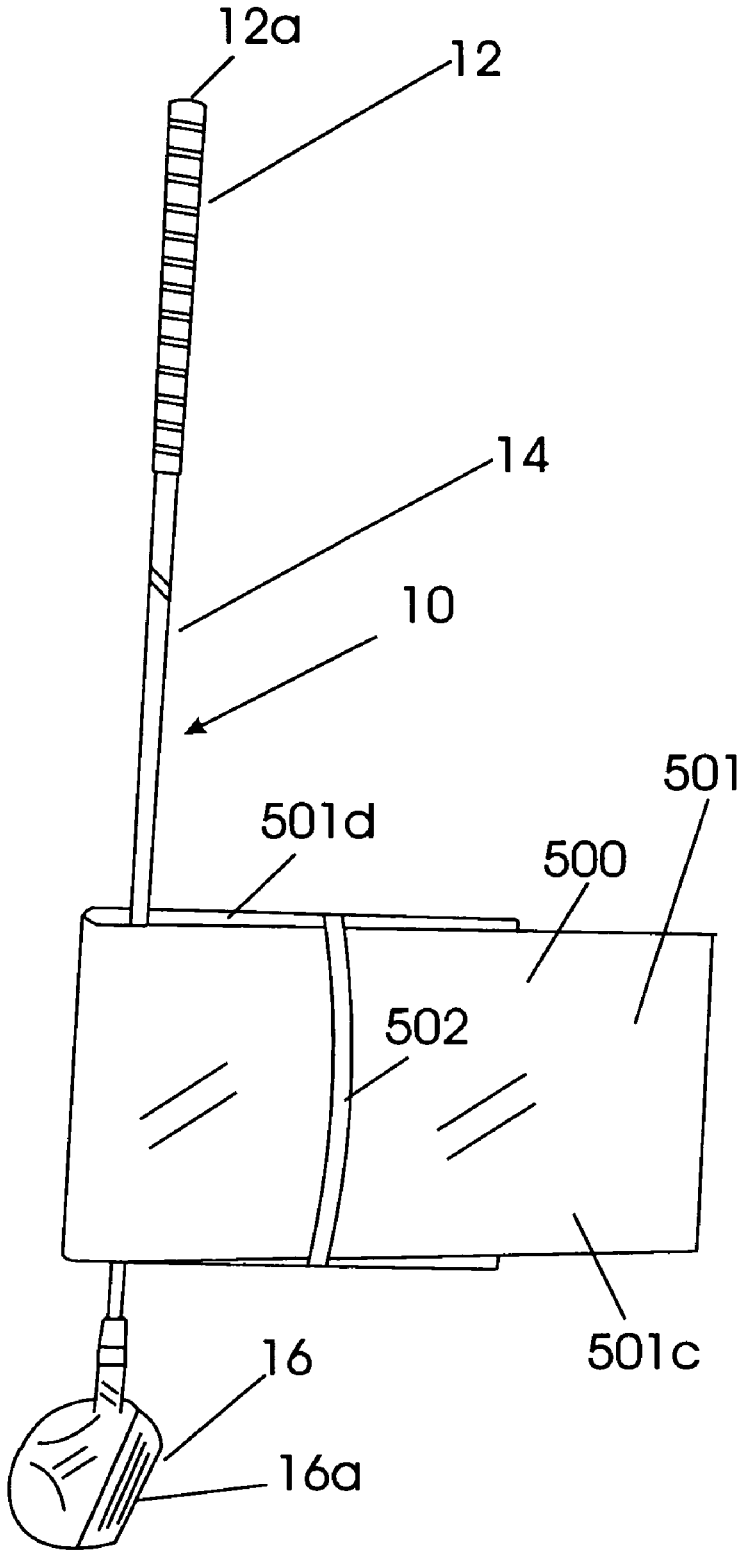
FIG. 6B shows a perspective view of the towel of FIG. 6A attached to the golf club of FIG. 1.

FIG. 6A shows a perspective view of a towel 500 having a band 502 for attaching the towel 500 to a golf club, such as golf club 10. The towel 500 is shown next to, but not attached to the golf club 10 in FIG. 6A. FIG. 6B shows a perspective view of the towel 500 of FIG. 6A attached to the golf club 10.

The towel 500 includes the band 502, which is attached to a flexible body portion 501 at ends 501*a* and 501*b*. A portion 501*c* of the body portion 501 can be folded over the shaft 14 and over a portion 501*d* of the body portion 501. The portion 501*c* can then be inserted between band 502 and body portion 501 as shown in FIG. 6B. The band 502 holds the portion 501*c* tightly against the portion 501*d*.

Although the invention has been described by reference to particular illustrative embodiments thereof, many changes and modifications of the invention may become apparent to those skilled in the art without departing from the spirit and scope of the invention. It is therefore intended to include within this patent all such changes and modifications as may reasonably and properly be included within the scope of the present invention's contribution to the art.

I claim:

1. An apparatus comprising a flexible body portion;

a band having first and second ends attached to first and second opposing edges, respectively, of the flexible body portion; and a golf club including a club head attached to a shaft;

wherein the flexible body portion is folded over itself and around the shaft of the golf club and a first portion of the flexible body portion is inserted between the band and a second portion of the flexible body portion, and the flexible body portion is thereby attached to the shaft of the golf club; and wherein the first portion of the flexible body portion can be pulled out from between the band and the second portion of the flexible body portion, and the flexible body portion can be thereby detached from the shaft of the golf club.

* * * * *